US006758730B1

(12) United States Patent
Bernhard

(10) Patent No.: US 6,758,730 B1
(45) Date of Patent: Jul. 6, 2004

(54) GRINDING MACHINE AND METHOD OF GRINDING GRASS MOWER ROTARY BLADES

(76) Inventor: Stephen Geoffrey Bernhard, 2 Church Walk, Rugby, Warwickshire, CV21 3 AZ (GB)

( * ) Notice: Subject to any disclaimer, the term of this patent is extended or adjusted under 35 U.S.C. 154(b) by 0 days.

(21) Appl. No.: 09/889,750

(22) PCT Filed: Jan. 20, 2000

(86) PCT No.: PCT/GB00/00143

§ 371 (c)(1),
(2), (4) Date: Oct. 25, 2001

(87) PCT Pub. No.: WO00/43160

PCT Pub. Date: Jul. 27, 2000

(30) Foreign Application Priority Data

Jan. 20, 1999 (GB) ..... 9901276

(51) Int. Cl.[7] ..... B24B 23/00
(52) U.S. Cl. ..... 451/349; 451/359; 451/344
(58) Field of Search ..... 451/45, 48, 344, 451/358, 234, 235, 229, 230, 122, 128, 248, 408, 409, 419, 349

(56) References Cited

U.S. PATENT DOCUMENTS

| | | | | |
|---|---|---|---|---|
| 463,676 A | | 11/1891 | Bachelder et al. | |
| 1,183,224 A | | 5/1916 | Oswald | |
| 1,432,193 A | | 10/1922 | Lancaster | |
| 1,513,527 A | | 10/1924 | Arnold | |
| 1,968,609 A | * | 7/1934 | Madsen | 451/349 |
| 2,245,968 A | * | 6/1941 | Erdman | 451/421 |
| 2,517,947 A | | 8/1950 | Walker | |
| 2,522,960 A | | 9/1950 | Price | |
| 2,554,676 A | | 5/1951 | Masterson | |
| 2,613,483 A | * | 10/1952 | Lewis et al. | 451/349 |
| 2,747,344 A | | 5/1956 | Kickbush | |
| 2,786,370 A | | 3/1957 | Osborn | |
| 2,863,262 A | * | 12/1958 | Turner | 451/349 |
| 3,866,362 A | * | 2/1975 | Riach et al. | 451/423 |
| 3,996,818 A | | 12/1976 | Lindsay | |
| 4,694,613 A | * | 9/1987 | Bernhard | 451/150 |
| 5,062,322 A | | 11/1991 | Sinko | |
| 5,159,784 A | | 11/1992 | Varner, Sr. et al. | |
| 5,218,787 A | * | 6/1993 | Rice | 451/229 |
| 5,329,731 A | * | 7/1994 | Wall | 451/234 |
| 5,371,977 A | | 12/1994 | Liner | |
| 5,618,226 A | * | 4/1997 | Ueyama | 451/234 |
| 5,725,415 A | | 3/1998 | Bernhard | |
| 5,893,792 A | * | 4/1999 | Scott | 451/45 |
| 6,257,967 B1 | * | 7/2001 | Schultz | 451/349 |
| 6,364,750 B2 | * | 4/2002 | Bauer | 451/45 |
| 6,471,569 B1 | * | 10/2002 | Bernhard | 451/224 |

FOREIGN PATENT DOCUMENTS

| | | |
|---|---|---|
| EP | 0308053 A | 1/1988 |
| GB | 855500 | 5/1958 |
| GB | 1097106 | 4/1966 |
| GB | 1395503 | 7/1972 |
| GB | 1542716 A | 5/1976 |
| JP | 09 155700 A | 6/1997 |
| WO | WO 82 01341 A | 4/1982 |

* cited by examiner

*Primary Examiner*—Lee D. Wilson
(74) *Attorney, Agent, or Firm*—Needle & Rosenberg, PCC.

(57) ABSTRACT

A portable grinding machine for grinding or restoring a relief angle (34) onto the rotary blades of a grass mowing machine in a transverse reciprocal movement the grinding machine comprising a blade support means for automatically maintaining the rotary blades (2, 102) of said mowing machine in contact with the grinding wheel (5, 105) during the reciprocal movement of the grinding machine along a blade.

12 Claims, 3 Drawing Sheets

2

GRINDING MACHINE AND METHOD OF GRINDING GRASS MOWER ROTARY BLADES

The present invention relates to grinding machines, in particular grinding machines for restoring a relief angle on the part-helical rotary blades of grass mowers of the type having a cylindrical cutting unit. The invention also provides a method of restoring a relief angle on the part-helical rotary blades of a reel mower.

Cylinder or reel mowers comprise one or more cylinders or reels bearing a plurality of part-helical blades and mounted for rotation about a horizontal axis transverse to the direction of motion of the mower. Each cylinder or reel cuts the grass in co-operation with an elongate bottom blade, commonly referred to as a bedknife, which is disposed alignment with the reel and positioned for the grass to be positioned accurately allowing the helical blade to cut the grass in a transverse scything motion. The faces of the rotary blades become worn during grass cutting and are required to be sharpened periodically by grinding. After repeated sharpening, the relief angle ground into the cutting face of the blade when it was manufactured is removed, thus potentially compromising the efficiency of the mowing process. The present invention prolongs the life of the rotary blades by grinding or restoring the relief angle.

Known grinders comprise a grinding wheel movable to and fro along a guide rail whilst rotating to grind the front face of a rotary blade. In order to grind the rotary blades of a mower with such known machines, the reel must be removed from the mower and mounted on the grinder; alternatively the mower or, especially in the case of tractor mounted mowers, a disassembled part thereof, must be placed on the grinder.

Prior art blade grinders, therefore, have required the mowing machine or a part of the mowing machine to be taken to the grinder. Tractor mounted mowers, and often walking mowers, have had to be disassembled to permit the reel or a part of the mowing machine including the reel to be placed on the grinder.

One example of a portable device capable of in situ grinding is disclosed in U.S. Pat. No. 2,245,968 to Erdman. This device is slidably mounted to a bar fitted to the mower to enable a reciprocal grind motion along either the bedknife or rotary blades of a mower. The device has a releasable slide mechanism to adjust the angle of grind on the blade and screw adjustment to vary the grinding depth.

The present invention seeks to provide a portable grinding machine for grinding a relief angle onto a rotary blade incorporated in cutting apparatus. The grinding machine can therefore be mounted on the cutting apparatus with the machine and the cutting apparatus in suitable relative disposition for grinding of the blade without prior disassembly or adjustment of the cutting apparatus, i.e. the blade can be ground whilst the cutting apparatus is in a complete and assembled state and no special changes and only minimal adjustments need to be made to the complete mower.

According to one aspect of the invention, there is provided a portable grinding machine for grinding or restoring a relief angle onto the rotary blades of a grass mowing machine in a transverse reciprocal movement which grinding machine comprises a blade support means for automatically maintaining the rotary blades of said mowing machine in contact with the grinding wheel during the reciprocal movement of the grinding machine along a blade.

According to an optional feature of this aspect of the invention the blade support means is adapted to retain the blade between said finger and the grinding wheel. Optionally, said guide means is adjustably mounted relative to the grinding wheel by first adjustment means to accommodate blades of different. Preferably, the guide means terminates in a roller which contacts the underside of the blade.

According to another optional feature of this aspect of the invention the blade support means is resiliently biased relative to the grinding wheel such that increased force applied to the grinding machine in a direction perpendicular to the direction of grinding results in a greater grinding depth.

In yet another optional feature of this aspect of the invention the grinding machine is handheld.

In yet another feature of this aspect of the invention a guide r ail is provided with opposite ends, a grinding wheel assembly is provided for receiving said portable grinding machine, which assembly is mounted for movement to and fro along, said guide rail, and said guide rail has readily releasable attachment members for releasably securing the grinder on the mowing machine such that when said grinding wheel is moved along said guide rail the grinding wheel can move along a blade face of said rotary blade and grind it. Optionally, first adjustment means is provided to adjust the position of said guide rail adjacent its opposite ends relative to said rotary blade, and second adjustment means being provided to adjust said grinding wheel assembly relative to said guide rail and hence relative to said blade face of said rotary blade.

According to an optional further feature of this aspect of the invention, the first adjustment means includes means for varying the position of said attachment member in a first direction perpendicular to the longitudinal axis of the guide rail. Preferably, the first adjustment means comprises one locking lever secured to each attachment member, and slidable within a respective slotted bracket, said slotted brackets being secured to said guide rail. Preferably, the second adjustment means comprises adjustment means in a second direction perpendicular to the longitudinal axis of the guide rail. Preferably, the second adjustment means adjusts the depth of grinding.

In to a another optional feature of this aspect of the invention the second adjustment means comprises a slidable locking means and a rotary control knob attached to a threaded feed screw.

In yet another optional feature of this aspect of the invention the angle of grind: is controlled by adjusting the first and second adjustment means.

In yet another optional feature of this aspect of the invention the attachment members are magnets.

A second aspect of the of the invention provides a method of grinding a relief angle onto a rotary blade of a reel mower, comprising orienting the complete mower to expose the rotary blades, attaching to the mower a portable grinding machine which comprises a guide rail, a grinding wheel assembly receiving a rotary grinding wheel which assembly is mounted for movement to and fro along said guide rail, including the steps of adjusting attachment means to orientate said guide rail relative to a reel on which the rotary blades are mounted so that it is substantially parallel to the axis of the reel and adjusting said grinding wheel assembly to introduce said supporting means to maintain contact between the grinding means and a single rotary blade so that the relief angle of the rotary blade can be ground throughout its length by allowing the reel to rotate as the grinding wheel assembly is moved along the length of the guide rail, repeating the process until all of the blades mounted oil the mower reel have been ground.

According to a third aspect of the invention, there is provided a method of grinding a relief angle onto a rotary blade of a reel mower comprising orienting the mower to expose the rotary blades adjusting a finger mounted on a grinding machine to retain the blade between the finger and a grinding wheel, removing the grinding machine away from contact with the blade, starting the power until connected to the grinding wheel, trapping the blade between the finger and the grinding wheel, and commencing grinding in a reciprocating transversing motion, applying a force to the grinding machine has ground the blade to the required depth, repeating the process until all of the blades mounted on the mower reel have been ground.

Embodiments of the invention are further described by way of example only, with reference to the accompanying drawings, in which.

Figures 1, 1A:
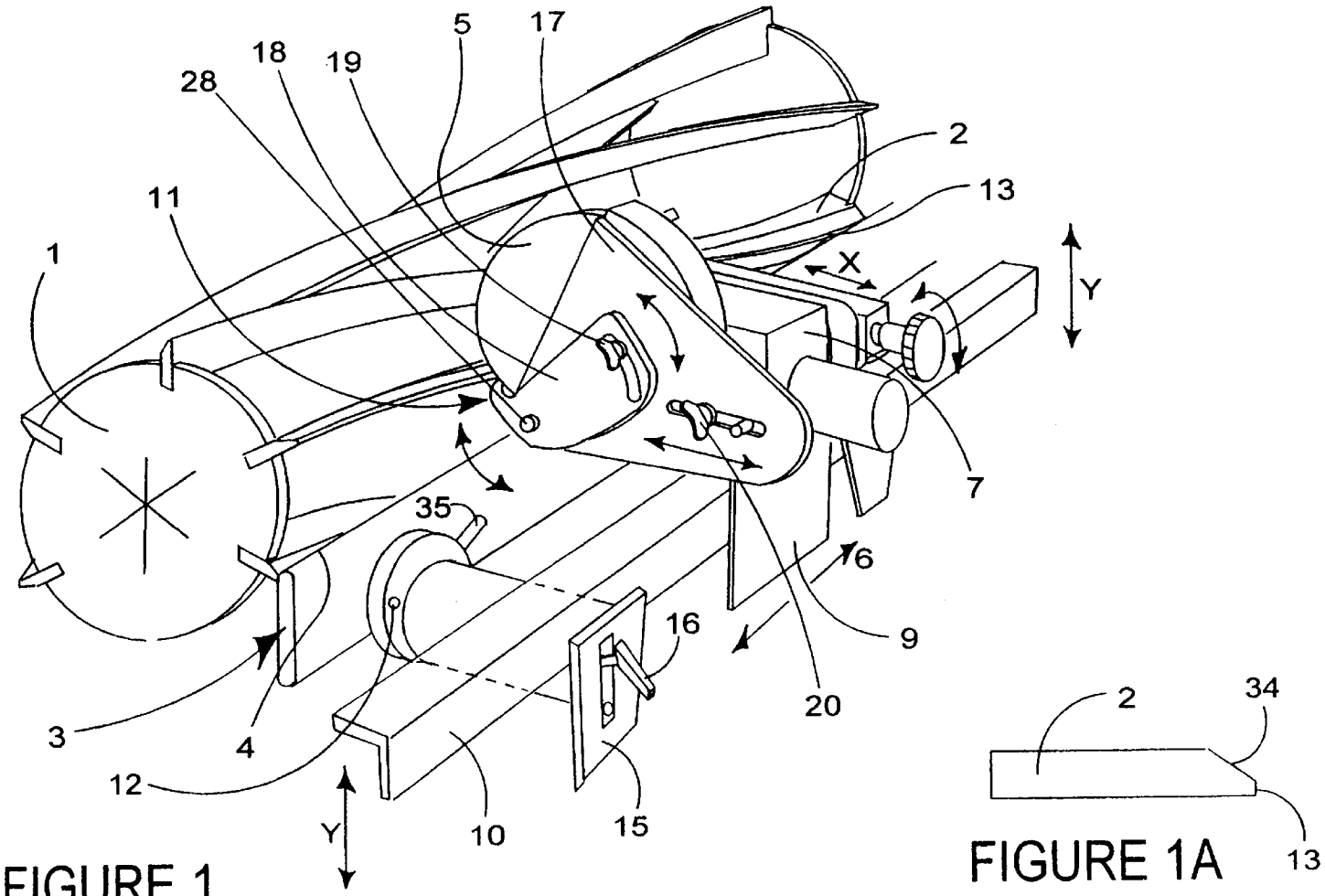
FIG. 1 is a perspective view of a grinding machine of the first embodiment of the invention supported on a complete mowing machine (not shown)
FIG. 1A is a schematic cross section of a part helical rotary mower blade.

Referring first to FIG. 1, there is shown generally at 1 a reel of a reel mower, the reel being provided with a plurality of part helical blades 2. The mower also includes a bottom blade or bedknife 3, positioned such that in use grass is severed and cut by the blades 2 and held by the bedknife 3 at a front face 4 of the bedknife 3. In the illustrated embodiment, the mower is turned on its back on its frame (not shown), such that the underside of the mower and its bedknife 3 is exposed. The mower is in its complete, assembled state. For the sake of clarity, only the reel 1 and the bedknife 3 of the mower are shown. The invention allows for the mower to be so ground as not to require the mower head to be moved substantially from its normal cutting position.

Figure 2:
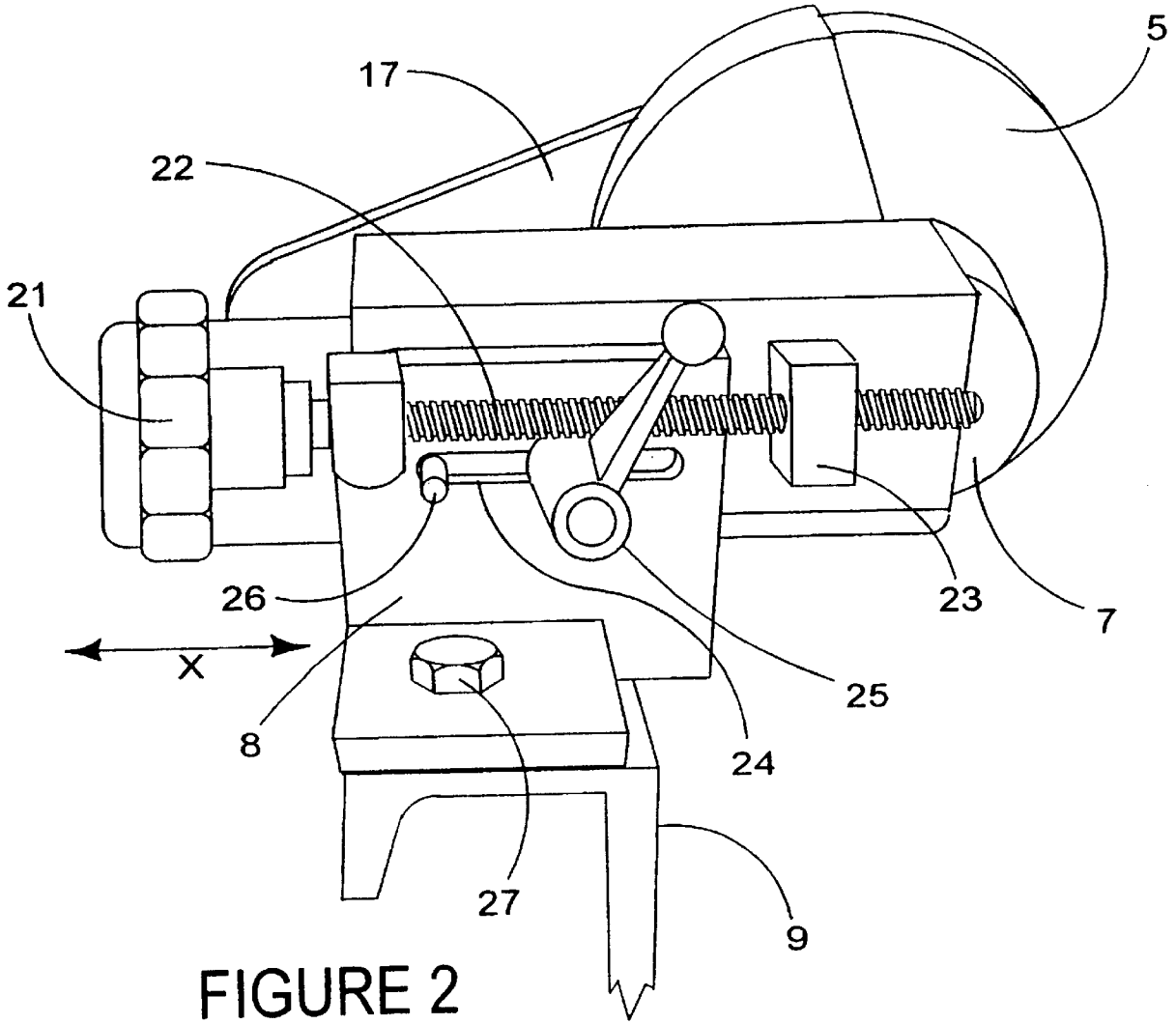
FIG. 2 is a partial perspective view of the grinding machine of FIG. 1, showing the blade supporting means and adjustment means to alter the depth of grinding.

FIGS. 1 and 2 show, in partial view, a grinding machine according to the first embodiment of the invention supported on a complete mowing machine (not shown) for grinding of the rotary blade thereof. More particularly, there is shown a portable grinding machine for grinding or restoring a relief angle 34 onto the rotary blades of a grass mowing machine. The grinding machine comprises a blade supporting means for automatically maintaining the rotary blades 2, 102 of said mowing machine in contact with the grinding wheel 5, 105 during the reciprocal movement of the grinding machine along the blade 2, 102. They also illustrate a grinding machine for grinding a substantially linear blade part helical or substantially linear rotary blade incorporated in cutting apparatus.

In this embodiment, the grinding machine comprises a grinding wheel arranged for reciprocal linear motion and means for adjustably but securely supporting the grinding machine on the cutting apparatus such that the grinding wheel can move along the blade and grind it. In one class of embodiments, a grinding wheel assembly is provided which grinding wheel assembly comprises a frame 7 for holding a rotary grinding wheel 5 arranged to traverse reciprocally along the face 34 relative to the front face 13 of one rotary blade 2 at a time in the directions indicated by a double arrow 6. The rotary grinding wheel 5, therefore, is coupled to rotary drive means. It is envisaged that the drive means can be provided by an electric motor or other suitable means known in the art.

The grinding wheel assembly may also include means for adjusting the depth of the grinding wheel 5 relative to the rotary blade leading edge 13, described in more detail below. In this embodiment, the depth adjustment means effects interconnection of the grinding wheel 5 with a traverse carriage 9 via a support means 8, the carriage 9 being slidably supported by a guide rail 10 of the grinding machine. The guide rail 10 is shown to be in the form of an angle iron, but in principle may have any desired cross-sectional profile.

It will be seen, therefore, that the grinding wheel assembly includes a carriage 9 slidable to and fro along the guide rail 10, which carriage 9 supports the rotary wheel 5 via support means 8.

It is not essential that the grinding machine have such a grinding wheel assembly; any suitable arrangement for providing a reciprocally linearly movable and depth adjustable rotary grinding wheel may be used.

The guide rail 10 can be supported in a frame (not shown) to which may be suitably mounted a drive motor or manual means (not shown) for causing reciprocal movement of the traverse carriage 9 along the guide rail 10. Those skilled in the art will be familiar with drive mechanisms for the traverse carriage of a bedknife grinder and, as an example of such a system, there may be mentioned chain drives driven by electric motors. Limit stops may be provided at the opposed end regions of the guide rail 10, if desired.

The first embodiment shows the grinding machine supported on the mowing machine and detachably connected to the bottom blade to stabilise the grinding wheel. To this end, the grinding machine is provided with mounting or attachment means 12 for mounting or attaching the grinding machine to the mower. The attachment means 12 may comprise any device capable of releasably coupling the grinding machine to the mowing machine. In the illustrated embodiment, the attachment means comprises a pair of spaced apart strong permanent magnets 12. It is convenient for the magnets or other attachment means 12 to be arranged to be mounted on the bedknife 3 in such a way that they do not interfere with the grinding process. Thus, as shown, the grinding machine may be provided with one or more magnets 12 arranged for attachment to the bottom face of the bedknife 3. In other embodiments, the grinding machine is provided with attachment means arranged for mounting on other parts of the mowing machine. As alternatives to the illustrated magnets 12, the attachment means may be mechanical fixing means, for example bolts, brackets or clamps.

For purposes of stability, it is preferred that a plurality of spaced attachment members or magnets 12 be provided. The number of attachment members may be two. In this way the guide rail and hence the path of movement of the grinding wheel can be adjusted relative to the leading edge 13 of the rotary blade so that the grinding wheel is in contact with a rotary blade 2 throughout the length of the rotary blade regardless of its orientation within the frame of the mower.

FIG. 1 shows an arrangement in which each magnet 12 is coupled to the guide rail 10 by means permitting adjustment of the guide rail 10 relative to magnet 12 in a direction Y perpendicular to the longitudinal axis of the guide rail 10 indicated by double arrows. More particularly, the illustrated adjustment means permit movement of the magnets 12 in a direction perpendicular to the guide rail which is parallel with the bottom face of the bedknife 3.

To adjust the guide rail in the direction Y there is provided first adjustment means, for example a slotted bracket 15 extending in a direction perpendicular to that of the guide rail 10, and connected to the guide rail by a support plate and suitable locking means, for example a handle lock 16. The handle lock 16 co-operates with the support bracket to permit manual adjustment of the guide rail 10 relative to the magnet 12. Fine adjustment in this plane is provided by a cam assembly including a cam handle 35 interposed between the magnet 12 and support bracket.

Referring now to FIG. 2, to adjust the grinder in a plane designated by letter X and indicated by double arrows, there is provided second adjustment means. A support frame 8 incorporating a slot 24 in which a locking means is slidable is provided in this embodiment by locking lever 25. The locking lever 25 is attached to the grinder assembly via support assembly 7 to fix the grinder in the desired position. The locking lever 25 operates in conjunction with a guide pin 26 to ensure that the movement in the direction X is linear.

The depth of grinding in plane X is adjusted by suitable adjustable means, for example rotary control knob 21 which is connected to one end of threaded feed screw 22. A female portion 23, secured by welding or other suitable means to the grinder support assembly 7 moves along the length of the threaded feed screw 22 as the control knob 21 is turned, causing relative movement of the grinding wheel 5 in relation to the carriage 9, support means 8 and guide rail. Any alternative suitable depth adjustment means may be provided, however. The grinder assembly is preferably secured to carriage 9 by bolts 27 or other suitable fasteners.

The grinding wheel assembly may also comprise a side guard 17 slidably mounted relative to the grinding wheel 5. Locking means 20 sets the desired position of the side guard 17 relative to the grinding wheel 5. Blade support means is provided, for example by a member 18 pivotally mounted about a point 28 on the side guard 17, and which may be lockable by locking means 19. Suitable guide means, preferably a finger 11 protrudes from member 18, and is pivotally adjusted to retain a blade 2 between itself and the grinding wheel 5. The pivotal adjustment allows different blade thicknesses to be accommodated. The finger 11, 111 may terminate in a roller of similar configuration to 130, 131 (shown in FIGS. 4 and 5), or may have a low friction coating to ease the reciprocal traversing.

An advantage of the first embodiment is that by utilising all of the above described adjustment means, it is possible to set the grinding machine so that the blade 2 may contact an infinite number of positions on the grinding wheel 5, and therefore the relief 34 may be restored within a wide range of known relief angle parameters.

Figure 3:
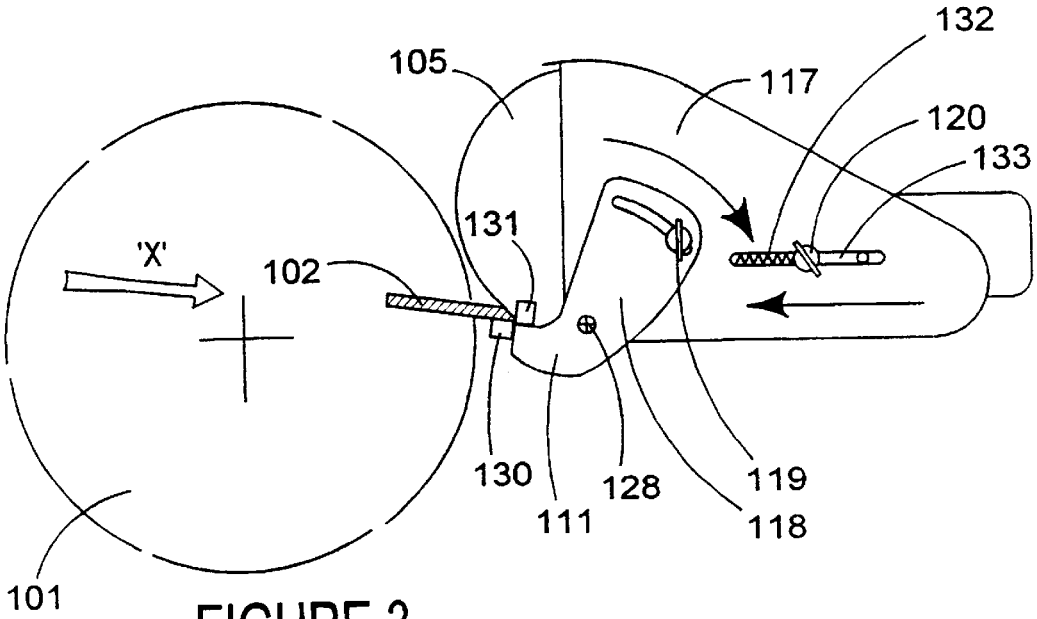
FIG. 3 is a side view of a grinding machine according to the second embodiment of the invention.
Figure 4:
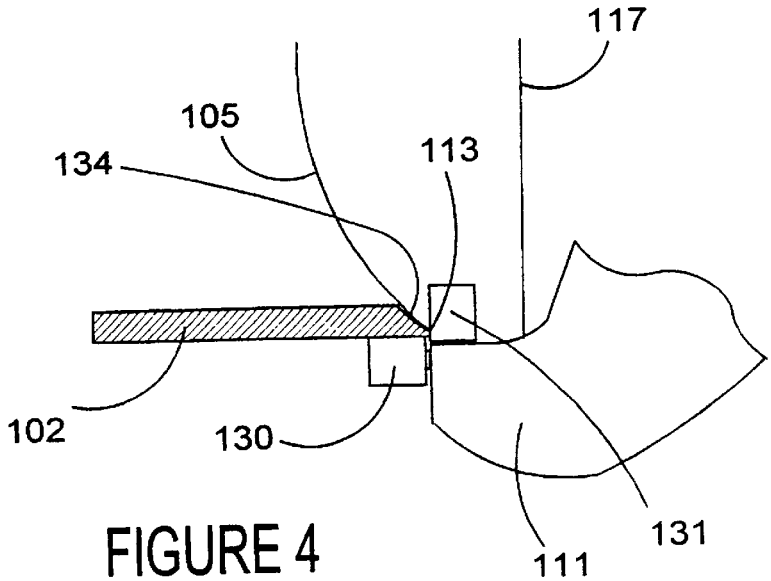
FIG. 4 is an enlarged view of the assembly used to guide the grinding machine of FIG. 3.
Figure 5:
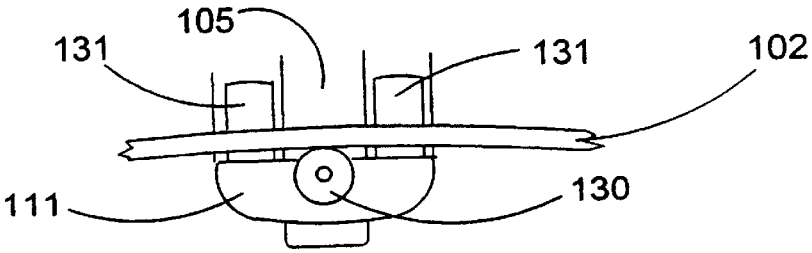
FIG. 5 is a view of the grinding machine from position "X" in FIG. 3

FIGS. 3 to 5 show a grinding machine according to the second embodiment of the invention. This embodiment illustrates a handheld means for grinding a substantially linear blade incorporated in cutting apparatus.

As in the first embodiment, there are shown generally at 101 a reel of a reel mower, the reel being provided with a plurality of part helical blades 102. The mower is again in its fully assembled state, however for the sake of clarity only reel 101 is shown, and the invention again allows for the mower to be so ground as not to require the mower head to be removed from its normal cutting position.

Blade support means, for example a side guard 117 is mounted to the peripheral grinding disc guard. Mounted on the side guard 117 Is a member 118 that is pivotal about point 128. Suitable guide means, for example a finger 111 protrudes from member 118 towards the blade 102. The angle of member 118 is set by locking means 119.

As can be seen more clearly from FIGS. 4 and 5, there is optionally mounted on guide means 111, a support roller 130 and guide 131 which may also be in the form of a roller. It is envisaged that the central support roller 130 and guide rollers 131 can be replaced by any suitable alternative guide means. For example, protrusions incorporating a low friction coating, could be used. In use, the guide means 111 is adjusted about pivot 128 so that blade 102 is retained between grinding disc 105 and support roller 130 which is mounted in line with grinding disc 105.

Preferably, the grinding machine is then removed from the blade 102 and drive means is started, for safety reasons and the grinding machine is then placed back on blade 102 with the blade 102 retained between the grinding disc 105 and the central support roller 130. The grinding machine is then moved to and fro along the length of blade 102 to grind relief angle 134. Pushing the grinding machine towards blade 102 causes the leading edge of the blade 113 to engage with the guides 131, and hence push against the side guard 117.

In some embodiments, the guard 117 is biased towards the reel 101 by suitable resilient means, for example a spring 132, so that when the side guard is pushed it is moved back against the force of spring bias 132 relative to the grinding wheel 105 to expose more of the wheel. An adjustable stop 120 mounted in a slot 113 on the side guard 117 limits the maximum depth of the cut.

Grinding machines according to the first embodiment of the invention are portable and releasably attachable to the underside of any complete mower, whether tractor mounted or pedestrian or are, according to the second embodiment of the invention hand held. The preferred grinding machines therefore permit the relief angle grinding of the rotary blades of any mowing machine without the necessity for any disassembly of the mowing machine or for the mowing machine to be taken to and placed on the grinding machine. Further, by using the bottom blade and/or the blade being thinned, it improves stability for the cutting (or grinding) head to apply a relief to the blade. The novel grinding machine of the invention is therefore particularly advantageous for golf courses or municipal authorities possessing a multiplicity of mowing machines possibly at different locations.

It will be understood that the grinding machine of the invention has been illustrated with reference to two specific embodiment and that numerous modifications are possible within the scope of the invention. The grinding machine of the invention is beneficial for grinding a relief angle onto the rotary blades of any machine containing such blades.

What is claimed is:

1. A portable grinding machine for grinding or restoring a relief angle onto the rotary blades of a reel or cylinder grass mowing machine in situ in a transverse reciprocal movement, each rotary blade having a blade face, the portable grinding machine comprising:

a. a grinding wheel;

b. a blade support means for automatically maintaining the rotary blades in contact with the grinding wheel during the reciprocal movement of the grinding machine along the rotary blade;

c. a guide rail having spaced ends, the guide rail secured to the mowing machine and having a longitudinal axis, wherein the grinding wheel is constructed and arranged for movement along the guide rail;

d. a first adjustment means for adjusting the position of the guide rail relative to the rotary blades; and e. a second adjustment means for linearly adjusting the grinding wheel relative to the guide rail so as to adjust a depth of grinding.

2. The portable grinding machine of claim 1, wherein the guide rail has releasable attachment members for releasably securing the grinding wheel relative to the mowing machine such that in use, the grinding wheel can move along the blade face of one rotary blade and grind it when the grinding wheel is moved along the guide rail.

3. The portable grinding machine of claim 2, wherein the first adjustment means includes means for varying the position of the attachment members in a first direction perpendicular to the longitudinal axis of the guide rail.

4. The portable grinding of claim 3, wherein said first adjustment means comprises:

a. a plurality of slotted brackets, each slotted bracket being secured to the guide rail; and b. a locking lever secured to each attachment member and slidable received within one slotted bracket.

5. The portable grinding machine of claim 2, wherein the attachment members are magnets.

6. The portable grinding machine of claim 1, wherein the second adjustment means adjusts the grinding wheel in a linear path perpendicular to the longitudinal axis of the guide rail.

7. The portable grinding machine of claim 6, wherein the second adjustment means comprises a slidable locking means for selective locking the grinding wheel at a predetermined position along the linear path and a rotary control knob connected to a threaded feed screw, the rotary control knob and feed screw being constructed and arranged for movement of the grinding wheel along the linear path to control a depth of grinding.

8. The portable grinding machine of claim 1, wherein the blade support means includes guide means for retaining the blade between a finger and the grinding wheel.

9. The portable grinding machine of claim 8, wherein the guide means is pivotally mounted relative to the grinding wheel to accommodate blades of different thickness.

10. The portable grinding machine of claim 9, wherein the guide means has a roller which contacts a portion of the rotary blade.

11. The portable grinding machine of claim 8, wherein the blade supporting means is resiliently biased relative to the grinding wheel.

12. The portable grinding machine of claim 1, wherein the first and second adjustment means are adjusted to change the relief angle.

* * * * *